US006503212B2

(12) United States Patent
Park

(10) Patent No.: US 6,503,212 B2
(45) Date of Patent: Jan. 7, 2003

(54) MASSAGE CHAIR FOR CARRYING OUT FOOT MASSAGE BY UTILIZING WHIRLPOOL

(75) Inventor: Jeung Hoon Park, Seoul (KR)

(73) Assignee: Beaunix Co., Ltd., Seoul (KR)

( * ) Notice: Subject to any disclaimer, the term of this patent is extended or adjusted under 35 U.S.C. 154(b) by 135 days.

(21) Appl. No.: 09/774,977

(22) Filed: Jan. 31, 2001

(65) Prior Publication Data

US 2001/0041852 A1 Nov. 15, 2001

(30) Foreign Application Priority Data

May 15, 2000 (KR) ..... 2000-25854

(51) Int. Cl.[7] ..... A61H 9/00; A61H 7/00

(52) U.S. Cl. ..... 601/158; 601/160; 601/157; 601/98; 601/99; 601/101; 601/102; 601/103; 601/90; 601/91; 601/93; 601/94

(58) Field of Search ..... 601/90, 91, 93, 601/94, 98, 99, 101, 103, 154, 155, 156, 157, 158, 159, 160, 168; 239/289; 297/284.8, 383

(56) References Cited

U.S. PATENT DOCUMENTS 4,160,292 A * 7/1979 Kuether et al.
4,718,408 A * 1/1988 Barreiro
5,044,357 A * 9/1991 Johns
5,179,940 A * 1/1993 Barreiro
5,813,727 A * 9/1998 Sugawa et al.

* cited by examiner

*Primary Examiner*—Michael A. Brown
*Assistant Examiner*—Benjamin K. Koo
(74) *Attorney, Agent, or Firm*—Harness, Dickey & Pierce, P.L.C.

(57) ABSTRACT

A massage chair capable of massaging even the foot by utilizing a whirlpool formed by the spouting of water is disclosed, in which the chair can be moved back and forth, its seatback can be reclined, and the instep and the sole of the foot can be massaged. The massage chair includes a supporting structure 20 and a seat 10. The seat 10 consists of a seat cushion 11 mounted and secured upon the supporting structure 20, and a seatback 12 upstanding on a rear edge of the seat cushion 11. A massaging mechanism 50 is internally installed within the seatback 12, and a seat moving mechanism 40 moves the seat cushion 11 back and forth. A foot bath tub 30 is formed on the supporting structure 20 in front of the seat cushion 11, and the foot bath tub 30 has water spouting holes 31, 32 and 33 on its bottom, on its side walls and on its rear wall respectively, and has a water spouting shower device 34 above it.

10 Claims, 13 Drawing Sheets

MASSAGE CHAIR FOR CARRYING OUT FOOT MASSAGE BY UTILIZING WHIRLPOOL

BACKGROUND OF THE INVENTION

1. Field of the Invention

The present invention relates to a massage chair which makes it possible to massage the back of a human body, and also make it possible to massage the foot by utilizing a whirlpool formed by the spouting of water. Particularly, the present invention relates to a massage chair in which the chair can be moved back and forth, its seatback can be reclined, and the instep and the sole of the foot can be massaged.

2. Description of the Prior Art

The massage chair is for dissipating the fatigue which has been accumulated in the neck and back of a human body, and recently, this massage chair is developed such that it can dissipate the fatigue of foot by spouting water on the foot.

This conventional massage chair includes: a seatback with a massaging device internally installed therein; and a cushion for supporting the buttocks. However, an angular adjustment of the seatback is impossible, and the seat and the foot bath tub cannot be moved but are fixed with the result that the distance between the seat and the foot bath tub cannot be adjusted. Accordingly, the conventional massage chair cannot suitably respond to the different sizes and postures of humans.

SUMMARY OF THE INVENTION

The present invention is intended to overcome the above described disadvantages of the conventional technique.

Therefore it is an object of the present invention to provide a massage chair in which the back and neck of a human body and the sole of foot can be massaged, the chair can be moved back and forth, its seatback can be reclined, and therefore, the chair can suitably respond to the different sizes and postures of humans.

In achieving the above object, the massage chair according to the present invention includes: a supporting structure; a seat consisting of a seat cushion mounted and secured upon the supporting structure, and a seatback upstanding at a rear edge of the seat cushion; a massaging mechanism internally installed within the seatback; a seat moving mechanism for moving the seat cushion back and forth; and a foot bath tub formed on the supporting structure in front of the seat cushion, and having water spouting holes on its bottom, on its side walls and on its rear wall respectively, and having a water spouting shower device above it.

The seat cushion moving mechanism of the massage chair according to the present invention includes: a lower frame installed upon the supporting structure and consisting of a pair of horizontal rails and a pair of threaded leads rotatably secured above the pair of the rails; a carrying motor installed on the lower frame, for rotating the pair of the leads forward and reverse; and an upper frame for supporting the seat cushion, for sliding along the pair of the rails, and for moving back and forth over the lower frame by the actuation of moving pieces, the moving pieces moving back and forth along the pair of the threaded leads by being coupled to the leads.

The seatback rotating mechanism of the massage chair capable of massaging a foot by utilizing a whirlpool according to the present invention includes: a seatback driving motor assembly installed on an upper frame, and having a reduction mechanism; and an extension rod consisting of a rotatable rod connected to the reduction mechanism of the motor assembly, and a fixed rod serially coupled to the rotatable rod, with its leading end being secured to a fixed rib of a lower portion of the seatback, for being moved back and forth by the rotatable rod so as to forcibly rotate the seatback, the seatback being hinge-coupled to the seat cushion.

The seat cushion lifting mechanism of the massage chair capable of massaging a foot by utilizing a whirlpool according to the present invention includes: a lifting frame, with its two rear sides being hinge-coupled to the upper frame vertically pivotally; and a link, the link being connected to a lower edge of the seatback, for lifting the front end portion of the seat cushion during the rotation of the seatback.

The lifting mechanism for the massaging mechanism of the massage chair capable of massaging a foot by utilizing a whirlpool according to the present invention includes: a supporting frame installed on the rear of the seatback, and having a pair of vertical rails and a pair of vertical leads; an elevating frame having the massaging mechanism, and secured to the supporting frame so as to move up and down along the vertical rails of the supporting frame by a lifting piece, the lifting piece being meshed with the leads; and a lifting device installed on the supporting frame, and consisting of a driving motor for rotating the leads forward and reverse to make the elevating frame ascend or descend.

The massaging mechanism of the massage chair capable of massaging a foot by utilizing a whirlpool according to the present invention includes: a massaging motor installed on the elevating frame, for being revolved forward and reverse; a clutch for connecting or disconnecting a power of the massaging motor; an eccentric shaft connected to the clutch, for being revolved eccentrically circularly; a biased shaft connected to the clutch, for performing precession movements; a pair of arms, with their rear ends being hinge-connected to the biased shaft, and their middle portions being joint-coupled to the leading end of the eccentric shaft; and a pair of arm brackets, with their lower portions being hinge-coupled to the leading ends of the arms, and their both ends having massaging rollers in a rotatable form.

The massage chair capable of massaging a foot by utilizing a whirlpool according to the present invention further includes: an ankle cushion surrounding the upper portion of the foot bath tub, for supporting an ankle.

The massage chair capable of massaging a foot by utilizing a whirlpool according to the present invention further includes an ankle cushion lifting mechanism, the ankle cushion lifting mechanism including: a pair of lifting bars installed within the front wall of the foot bath tub vertically movably, and having a plurality of engaging slots; an engaging bar contacted to the lifting bars, and having an elastic member to be inserted into one of the plurality of the engaging slots so as to limit the descending of the lifting bars; and a knob connected to the engaging bar, with its leading end being exposed toward the front portion of the foot bath tub, for forcing the horizontal motion of the engaging bar.

The massage chair capable of massaging a foot by utilizing a whirlpool according to the present invention further includes: a pair of arm rests respectively coupled to the upper frame, at least with one of the two arm rests being pivotal.

The massage chair capable of massaging a foot by utilizing a whirlpool according to the present invention further includes: heating wires internally installed within the seatback and within the seat cushion.

BRIEF DESCRIPTION OF THE DRAWINGS

The above object and other advantages of the present invention will become more apparent by describing in detail the preferred embodiment of the present invention with reference to the attached drawings in which.

DETAILED DESCRIPTION OF THE PREFERRED EMBODIMENTS

The present invention will be described in detail referring to the attached drawings.

Figure 1:
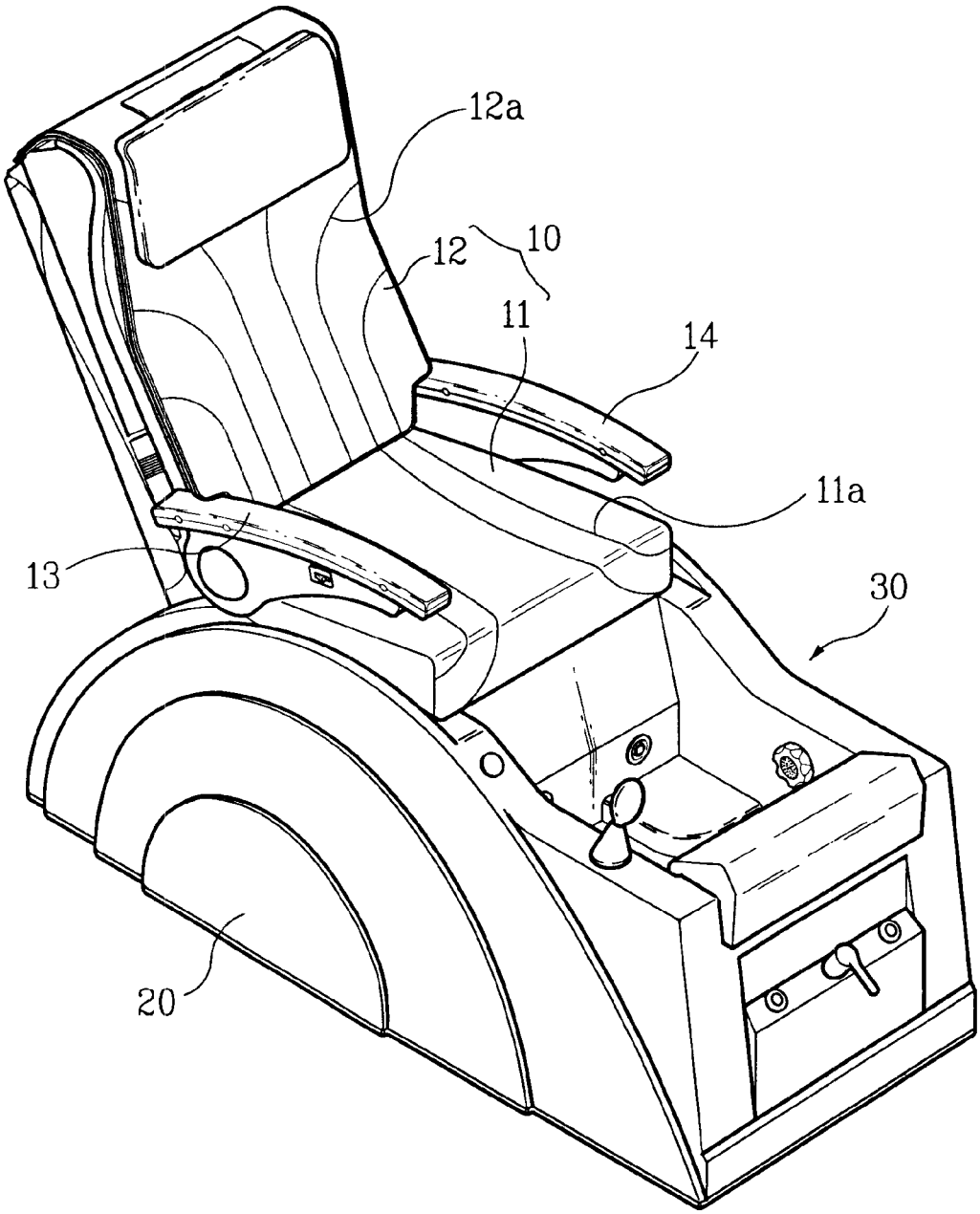
FIG. 1 is a perspective view of the massage chair according to the present invention.
Figure 2:
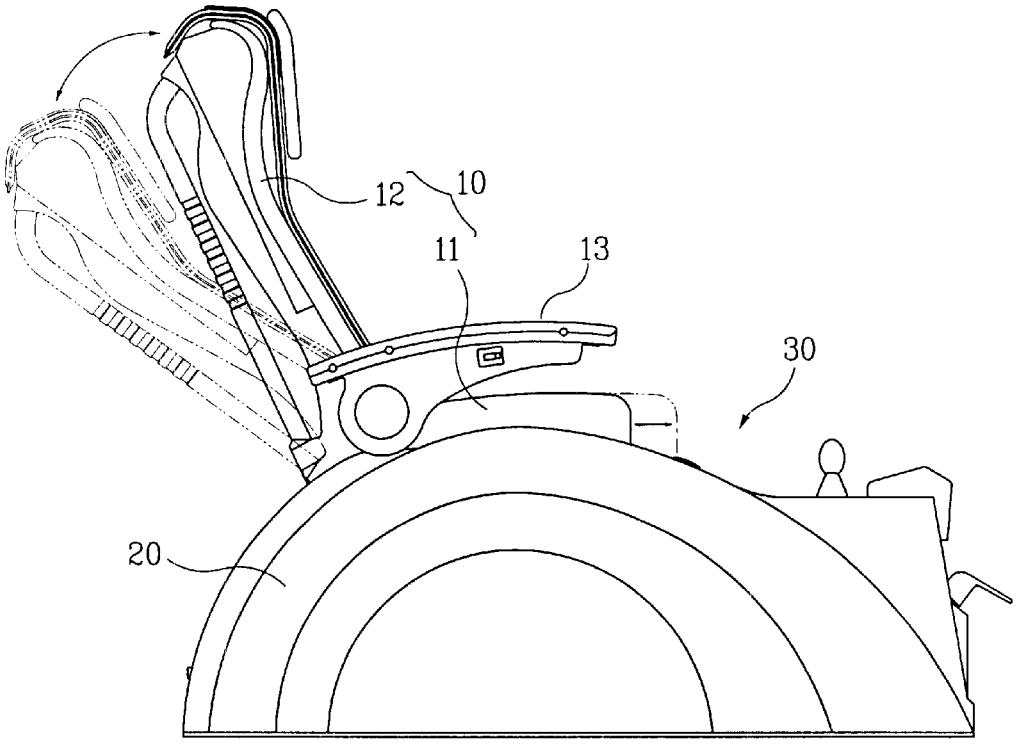
FIG. 2 illustrates the reclining of the seatback of the massage chair according to the present invention.

FIG. 1 is a perspective view of the massage chair according to the present invention. FIG. 2 illustrates the reclining of the seatback of the massage chair according to the present invention.

As shown in FIG. 1, the massage chair according to the present invention includes: a seat 10 for enabling a user to sit down on it for receiving a massage service; a supporting structure 20 for supporting the seat at a certain height; and a foot bath tub part 30 for massaging the foot by utilizing a whirlpool, the whirlpool being formed by spouting water.

The seat 10 includes: a seatback 11 for supporting the back of a human body; and a seat cushion 12 for supporting the buttocks. Each of them contains a heating wire 11*a* or 12*a* which generates a heat of 50 to 70 degrees C. to relax the muscles so as to double the massaging effect.

As shown in FIG. 2, the seat cushion 12 is installed in such a manner as to be movable back and forth over the supporting structure 20 so that the user can adjust the distance to the foot bath tub suitably to the length of the legs. The seatback 11 contains a massaging mechanism 50 (FIG. 5), and its lower edge is pivotally hinge-connected so that the user can adjust the inclination angle of the seatback 11 suitably to his or her comfortable feeling.

Figure 3:
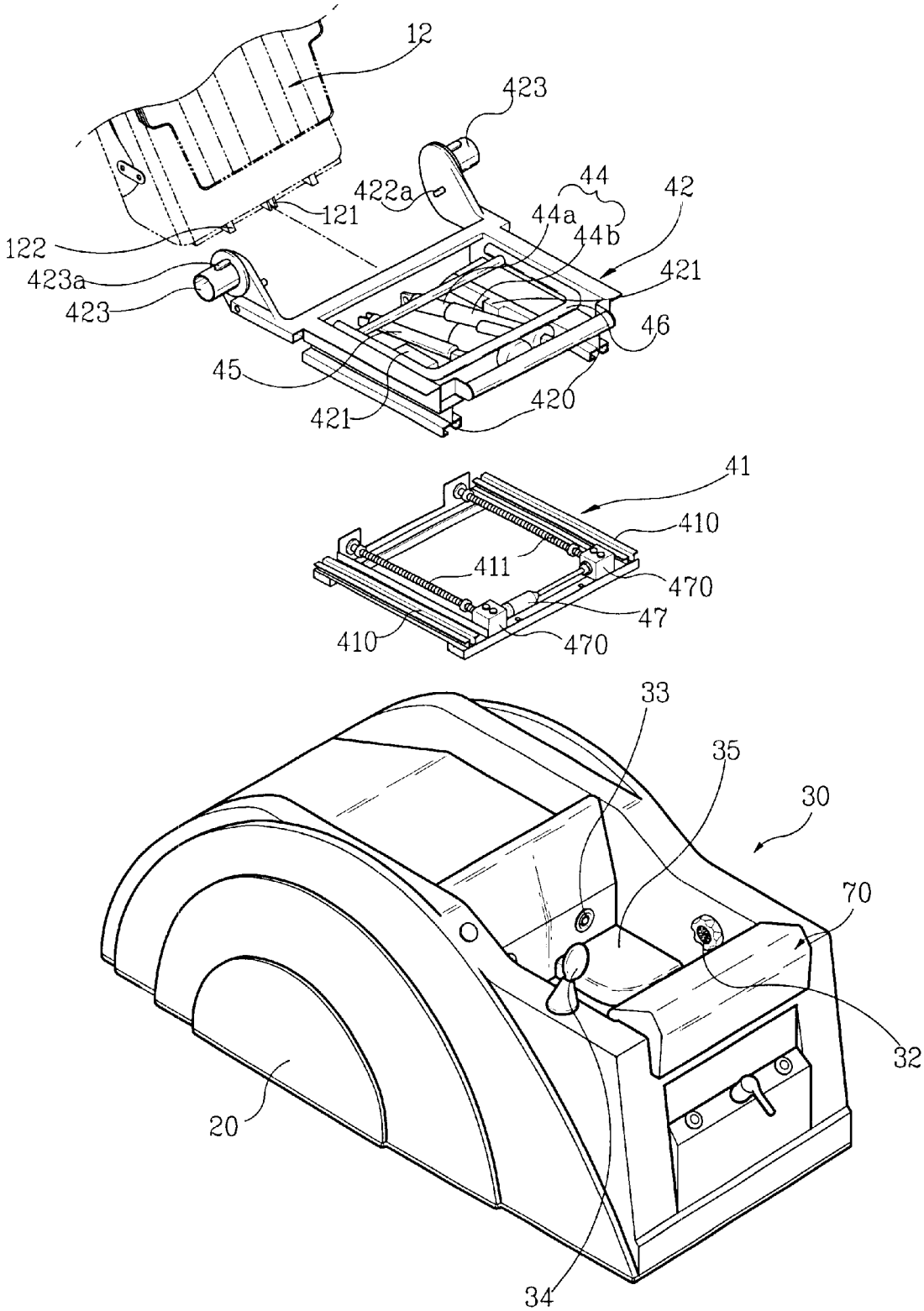
FIG. 3 is an exploded perspective view showing the seat cushion moving mechanism and the seatback rotating mechanism of the massage chair according to the present invention.
Figure 4:
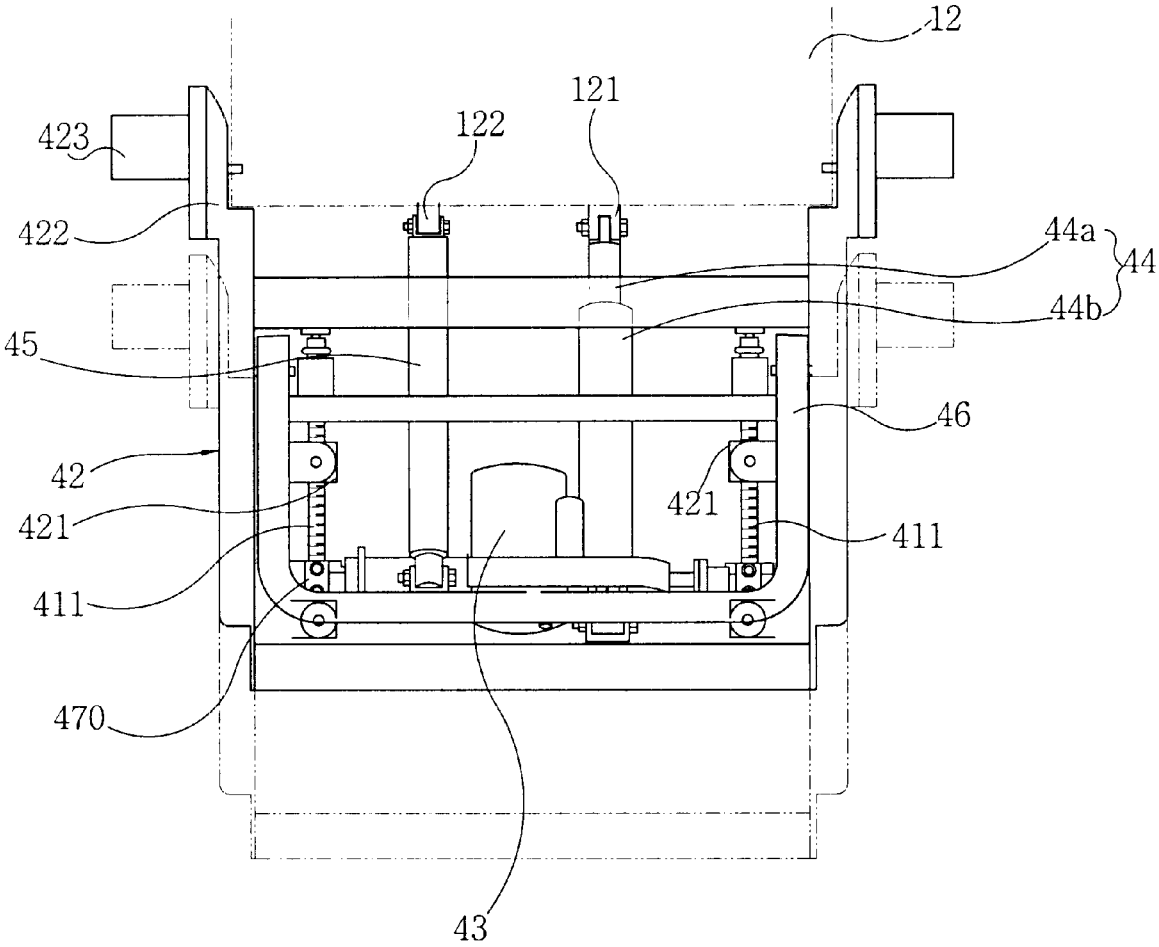
FIG. 4 illustrates the internal structures of the massage chair according to the present invention.

FIG. 3 is an exploded perspective view showing the seat cushion moving mechanism 40 and the seatback rotating mechanism of the massage chair according to the present invention. FIG. 4 illustrates the internal structures of the massage chair according to the present invention.

As shown in FIGS. 3 and 4, the seat cushion moving mechanism 40 of the massage chair according to the present invention includes: a rectangular upper frame 42 for supporting the seat cushion 11; a lower frame installed upon the supporting structure and consisting of a pair of horizontal rails for being mated with rail slots 420 of the upper frame 42 to slidably support the upper frame 42; a pair of threaded leads 411 installed within the lower frame 41; a pair of moving pieces 421 installed within the upper frame 42, the moving pieces 421 moving back and forth along the pair of the threaded leads by being coupled to the leads; and a carrying motor 47 installed on the lower frame, for rotating the pair of the leads 411 forward and reverse in accordance with electrical signals.

Thus in the seat cushion moving mechanism 40, the pair of the leads 411 are rotated forward and reverse by the carrying motor 47 in accordance with the electrical signals, and therefore, the moving pieces 421 move back and forth along the leads 411. Accordingly, the seat cushion 11 which is installed on the upper frame 42 can move back and forth.

Meanwhile, the seatback rotating mechanism includes: a seatback rotating motor assembly 43 installed on the upper frame 42; and an extension rod 44 consisting of a fixed rod 44*a* and a revolving rod 44*b* connected together threadably and serially. The leading end of the fixed rod 44*a* is fixedly connected to a fixed rib 121 of a lower portion of the seatback 12. Thus in the seatback rotating mechanism, the motor assembly 43 rotates the revolving rod 44*b* forward or reverse in accordance with electrical signals, and therefore, the moving rod 44*a* which is threadably coupled to the revolving rod 44*b* moves back and forth. As a result, the seatback 12 which is hinge-connected to hinge protuberances 422*a* of rear brackets 422 is rotated back and forth, thereby making it possible to adjust the inclination angle of the seatback 12.

Further, as shown in FIGS. 3 and 4, the massage chair according to the present invention further includes: a seat cushion lifting mechanism consisting of a link 45, the link 45 being for connecting the lower portion of the seatback 12 to the front portion of a lifting frame 46, and the lifting frame 46 being hinge-connected to the upper frame 42. Thus, when the seatback 12 is rotated by the seatback rotating mechanism, the lifting frame 46 is rotated up and down, and therefore, the inclination angle of the seatback 12 is adjusted, while the seat cushion 11 is interlocked to the seatback 12. Accordingly, if the inclination angle of the seatback 12 is adjusted, the inclination angle of the seat cushion 11 is also adjusted.

Figure 5:
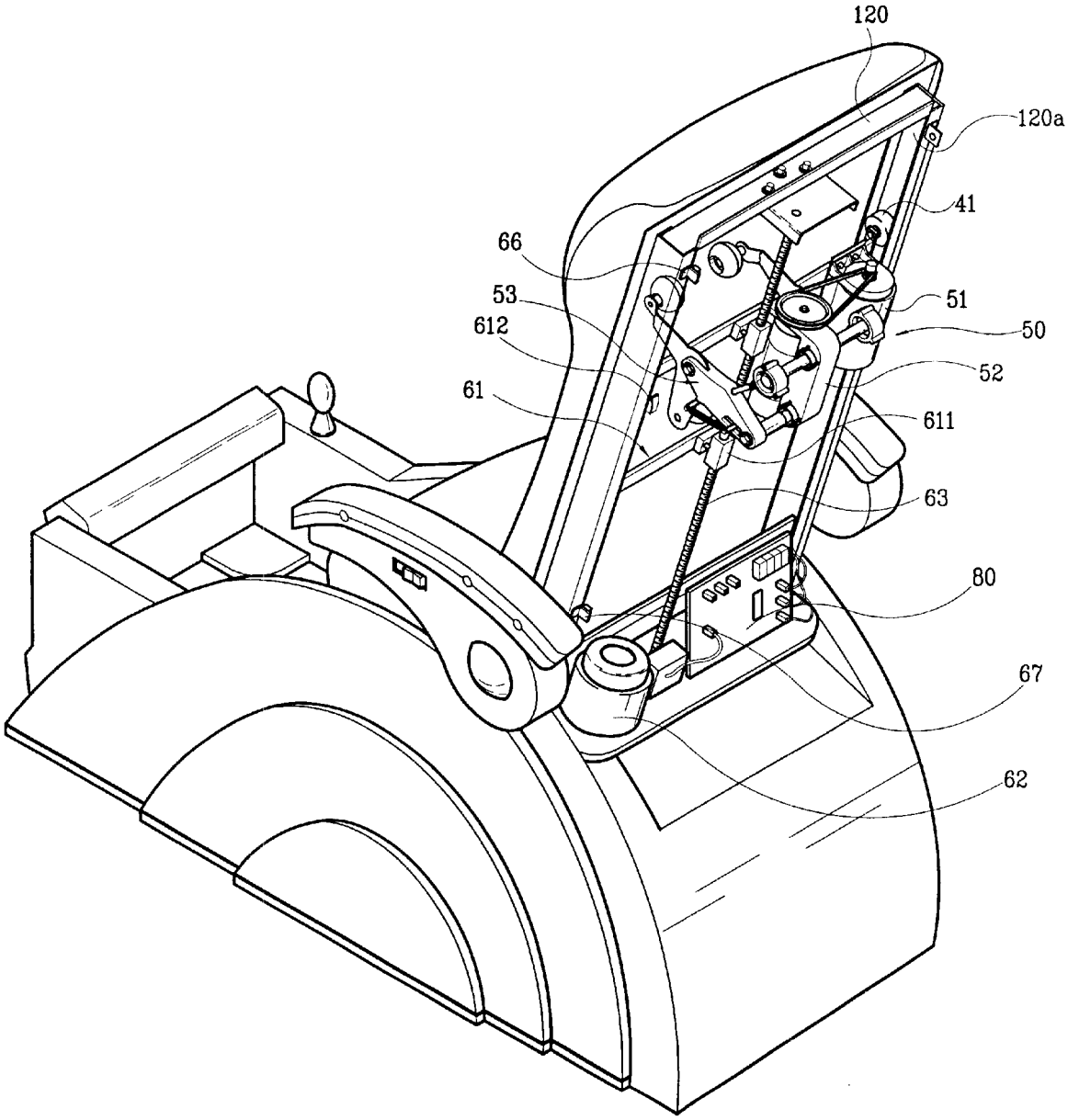
FIG. 5 is a rear perspective view of the massage chair according to the present invention.
Figure 6:
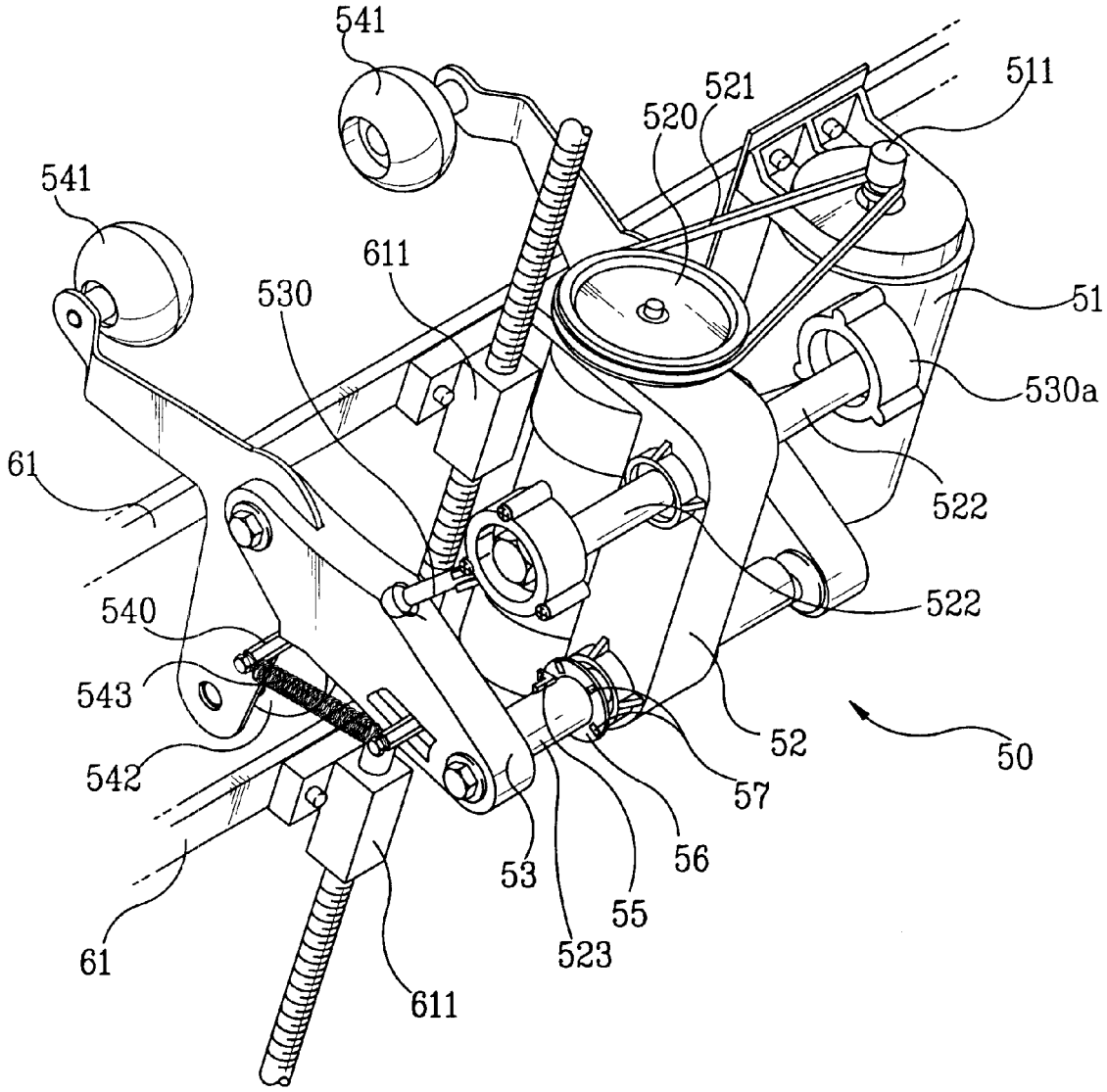
FIG. 6 is an enlarged perspective view showing the internal mechanism of the massage chair according to the present invention.

FIG. 5 is a rear perspective view of the massage chair according to the present invention. FIG. 6 is an enlarged perspective view showing the internal mechanism of the massage chair according to the present invention.

As shown in FIG. 5, the lifting mechanism which makes it possible for the massaging mechanism 50 to ascend and descend includes: a rectangular supporting frame 120 installed on the rear of the seatback 12, and having a pair of U cross-sectioned lifting rails 120*a* and a vertical lead 63; an elevating frame 61 for securing the massaging mechanism 50 and having an integral elevating piece 611, the elevating piece 611 being connected to the lead 63 and installed on the supporting frame 120; a lifting motor 62 installed on a lower portion of the supporting frame 120, for rotating the lead 63 forward and reverse; and a pair of limit switches 66 and 67 installed respectively above and below on the rear face of the seatback 12, and activated by a dog 65 to shift the phase of the electrical signals so as to reverse the rotation direction of the lifting motor 62. Reference code 80 in FIG. 5 indicates a control part which controls the electrical components such as the motors and the like.

In this lifting mechanism for lifting and lowering the massaging mechanism, when the lifting motor 62 rotates the lead 63 of the supporting frame 120 forward and reverse, the elevating frame 61 moves up and down along the rails 120*a* of the supporting frame 120 owing to the elevating pieces 611 which are threadably coupled to the lead 63. Thus, the massaging mechanism 50 which is installed at the rear of the elevating frame 61 moves up and down. Under this condition, if the elevating frame 61 moves up to the upper limit, then the dog 612 activates the upper limit switch 66, so that the lifting motor 62 would change its revolving direction, and that the elevating frame 61 would start to come down. On the other hand, at the lower limit, the elevating frame 61 also changes its moving direction to go up. Thus the massaging mechanism 50 actuates within the upper and lower limits.

Meanwhile, the massaging mechanism 50 includes: a massaging motor 51 installed on the elevating frame 61, for being revolved forward and reverse; a clutch 52 for connecting or disconnecting a power of the massaging motor and having two output shafts; an eccentric shaft 522 connected to one of the output shafts of the clutch 52, for being revolved eccentrically circularly; a biased shaft 523 connected to another of the output shafts of the clutch 52, for performing precession movements; a pair of arms 53, with their rear ends being hinge-connected to the biased shaft 523, and their middle portions being joint-coupled to the leading end of the eccentric shaft 522, so as to be pivoted back and forth by the eccentric shaft 522 and so as to be pivoted in a lateral direction by the biased shaft 523; and a pair of arm brackets 54, with their lower portions being hinge-coupled to the leading ends of the arms 53, and their both ends having massaging rollers 541 and 542 in a rotatable form by being supported by a tension spring 543.

Figure 7:
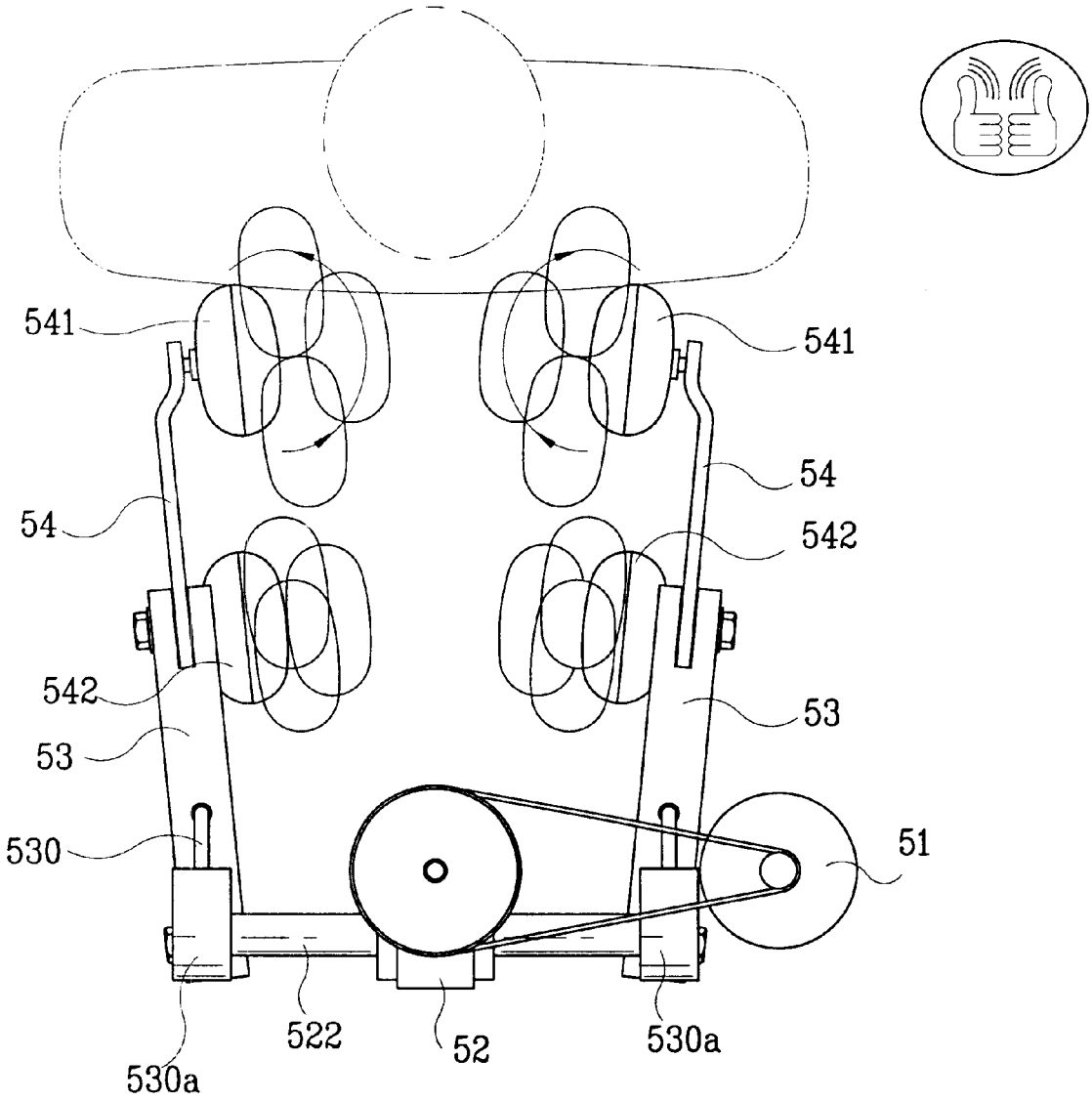
FIG. 7 is a plan view showing the actuation of the massaging mechanism of the massage chair according to the present invention.
Figure 8:
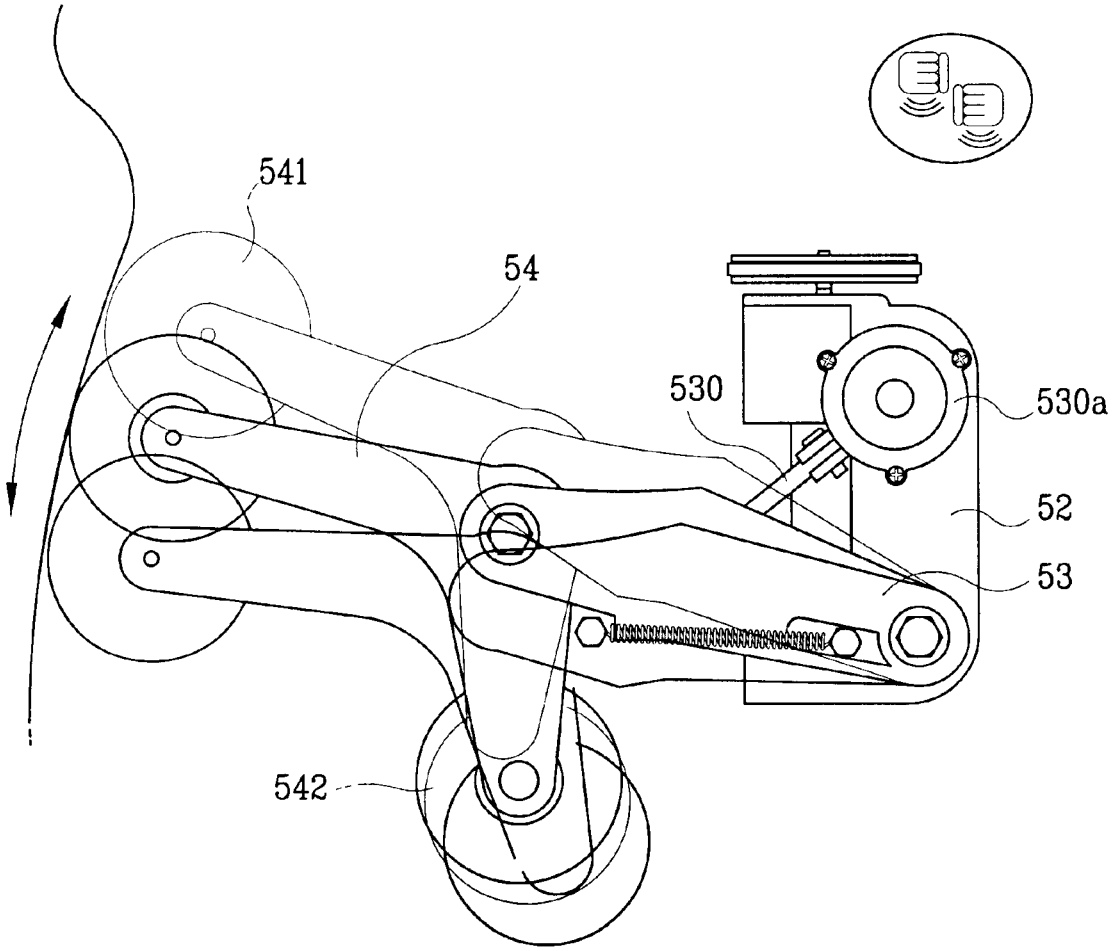
FIG. 8 is a side view showing the actuation of the massaging mechanism of the massage chair according to the present invention.

Thus, if the massaging motor 51 rotates the eccentric or biased shaft 522 or 523 through the clutch 52, then the arms 53 are pivoted back or forth, or in a lateral direction. Therefore, owing to the arms 53 or the arm brackets 54, the massaging rollers 541 and 542 perform lateral movements due to the precession movements of the biased shaft 523 as shown in FIG. 7, or perform up-down movements due to the circular movements of the eccentric shaft 522 as shown in FIG. 8. In this manner, the back of the user which is leaned on the seatback 12 is massaged.

Further, the massage chair of the present invention includes a pair of arm rests 13 and 14, and one 13 of them can be pivoted upward for the sake of the convenience of the user.

Figure 9:
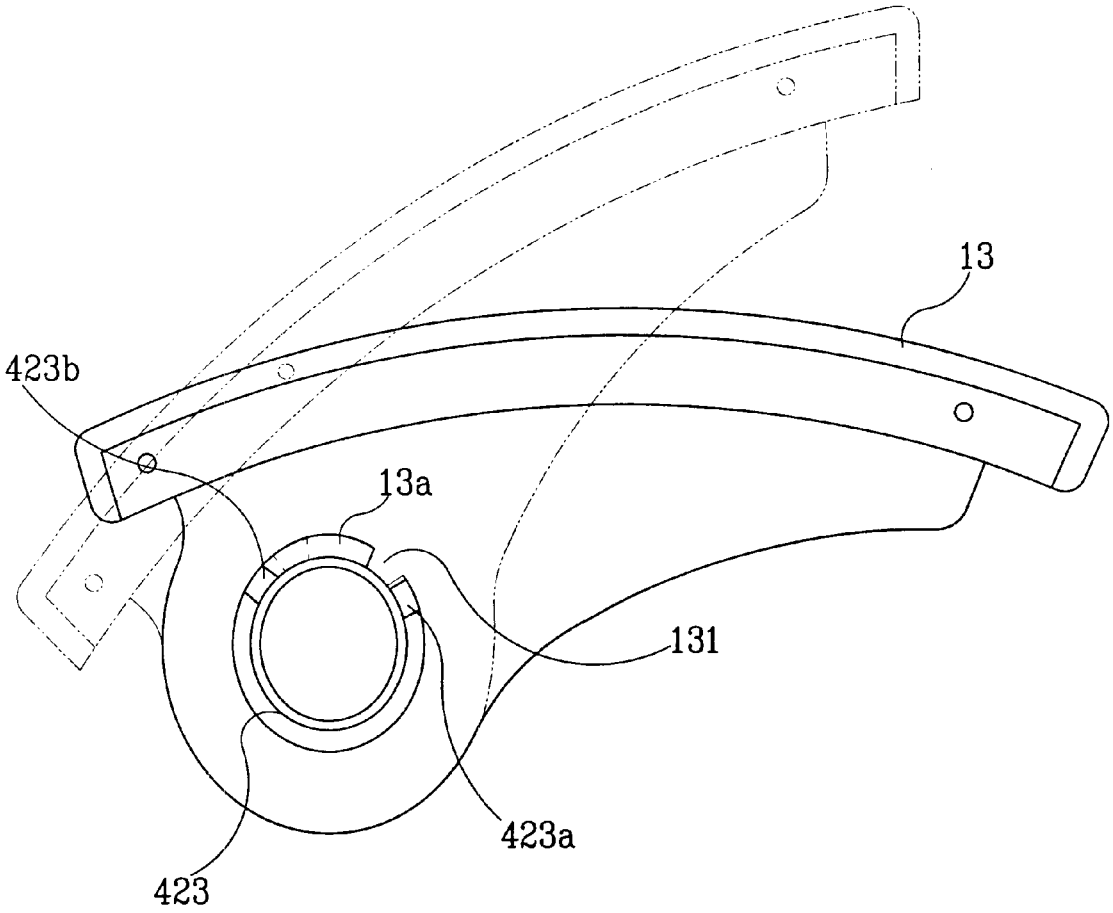
FIG. 9 illustrates the actuation of the arm rest of the massage chair according to the present invention.

That is, as shown in FIG. 9, the arm rest 13 is fitted to a projected fitting part 423 of a bracket 422, and thus, the arm rest 13 is secured to the upper frame 42. As shown in FIG. 9, this right arm rest 13 has a stopper 131, and this stopper 131 is disposed between two limiters 423*a* and 423*b* so that the stopper 131 of the right arm rest 13 can angularly move only between the limiters 423*a* and 423*b*. Therefore, the right arm rest 13 can be pivoted within the angular range which is decided by the limiters 423*a* and 423*b*. Therefore, when the user sit down on the massage chair, the user can lift up the right arm rest 13 so that the right arm rest 13 would not become an impediment.

Figure 10:
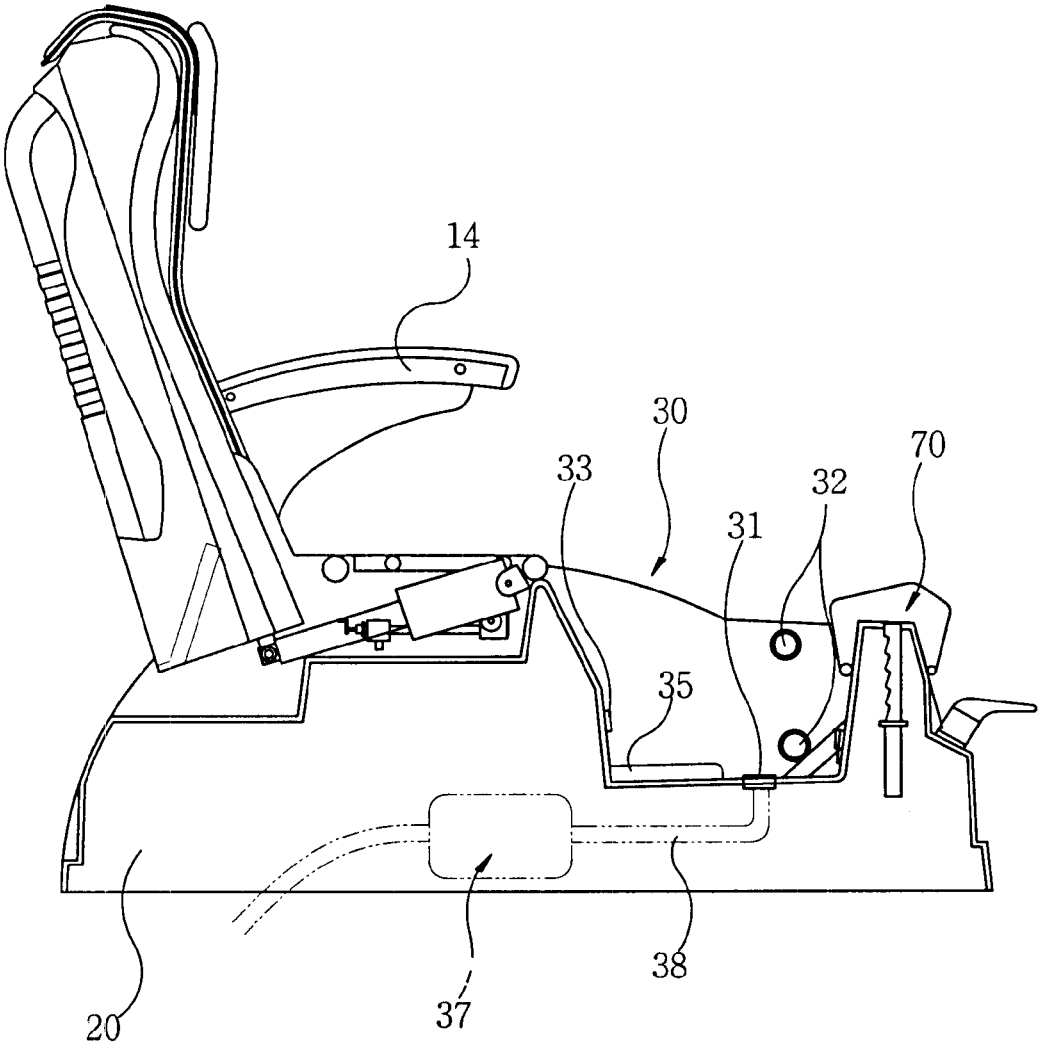
FIG. 10 is a side sectional view showing the constitution of the foot bath tub of the massage chair according to the present invention.
Figure 11:
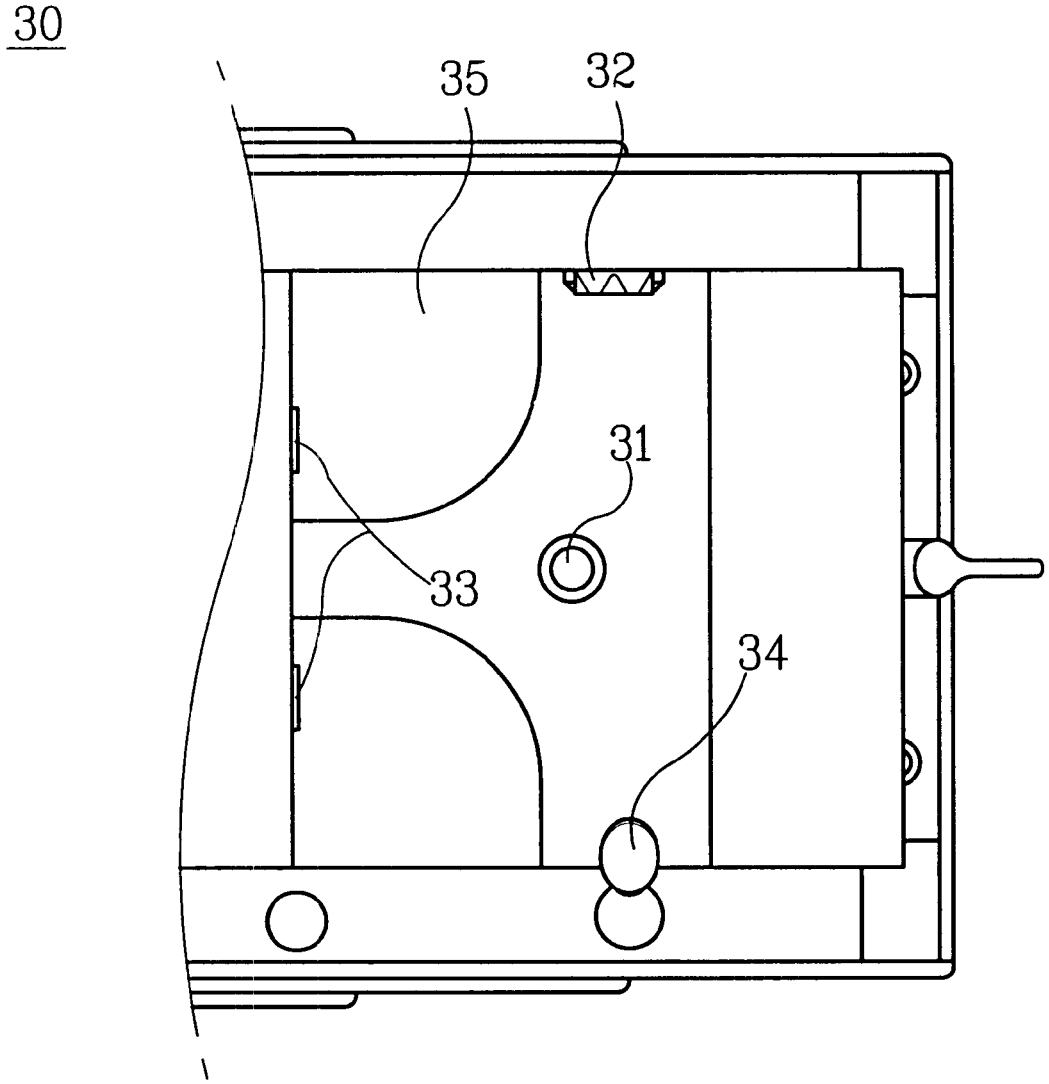
FIG. 11 is a plan view showing the constitution of the foot bath tub of the massage chair according to the present invention.

FIG. 10 is a side sectional view showing the constitution of the foot bath tub of the massage chair according to the present invention. FIG. 11 is a plan view showing the constitution of the foot bath tub of the massage chair according to the present invention.

As shown in FIG. 10, the massage chair capable of massaging a foot by utilizing a whirlpool according to the present invention further includes: a foot bath tub 30 installed on the supporting structure 20 in front of the seat cushion, and having a certain depth so as to make it possible to store a certain amount of water. The foot bath tub 30 includes: water spouting holes 31, 32 and 33 on its bottom, on its side walls and on its rear wall respectively, and a water spouting shower device 34 above it. On the front wall of the foot bath tub 30, there is provided an ankle cushion 70 so that the feet of the user can be placed on it. As can be seen in FIGS. 10 and 11, on the rear portion of the bottom of the foot bath tub 30, there is placed a foot pad 35, so that the sole of the foot of the user can be separated from the bottom of the foot bath tub 30, and that water streams from the water spouting holes 31, 32 and 33 can touch on the sole of the foot of the user. Thus even the sole of the foot can be massaged.

In this manner, water is spouted from the water spouting holes 31, 32 and 33 and from the shower device 34 into the foot bath tub 30, so as to form a whirlpool of water within the foot bath tub 30. Therefore, with the sole of the foot separated from the bottom of the foot bath tub 30, the whirlpool of water massages the instep and sole of the foot of the user.

Figure 12:
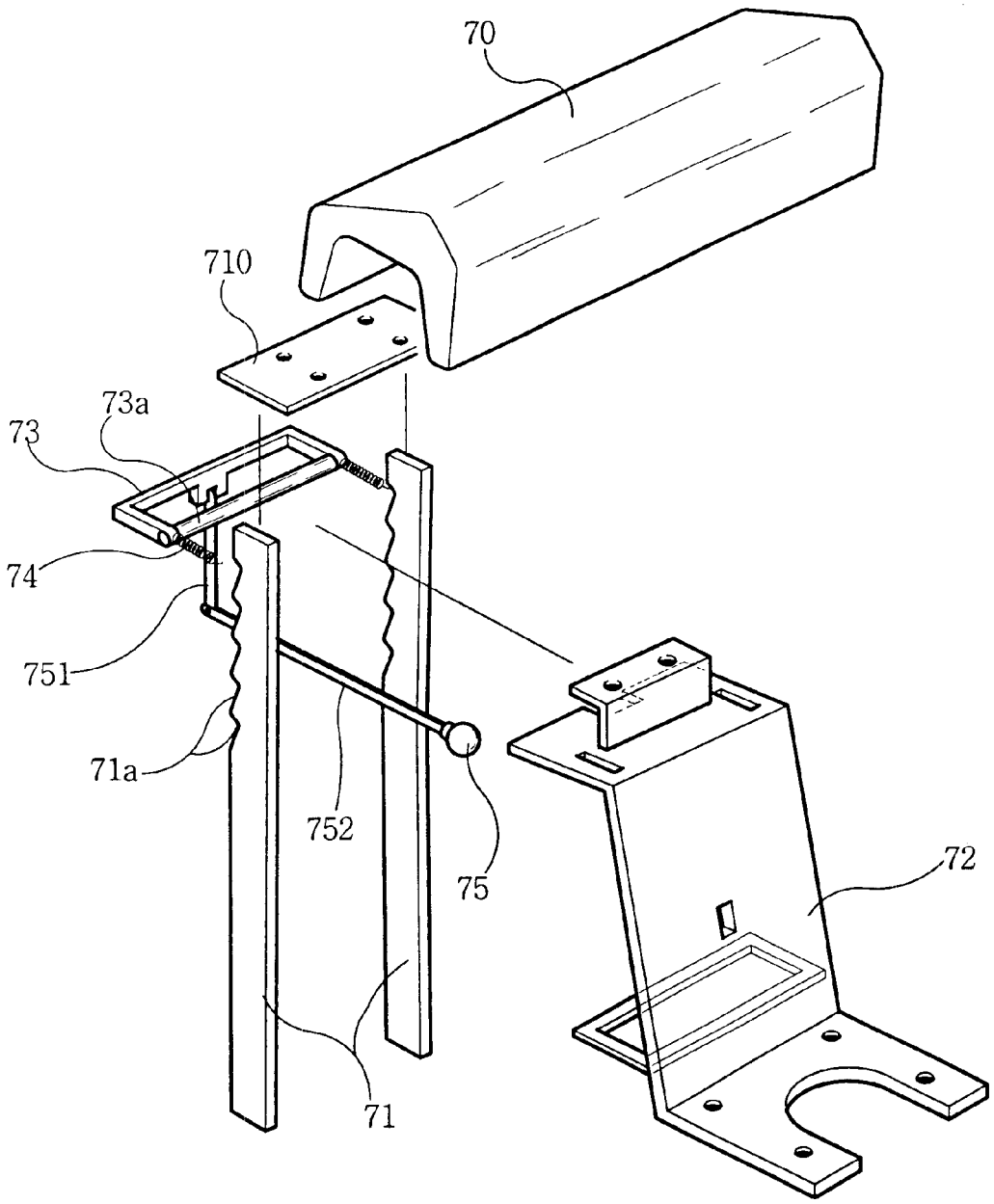
FIG. 12 is an exploded perspective view showing the constitution of the ankle cushion lifting mechanism of the massage chair according to the present invention.
Figure 13:
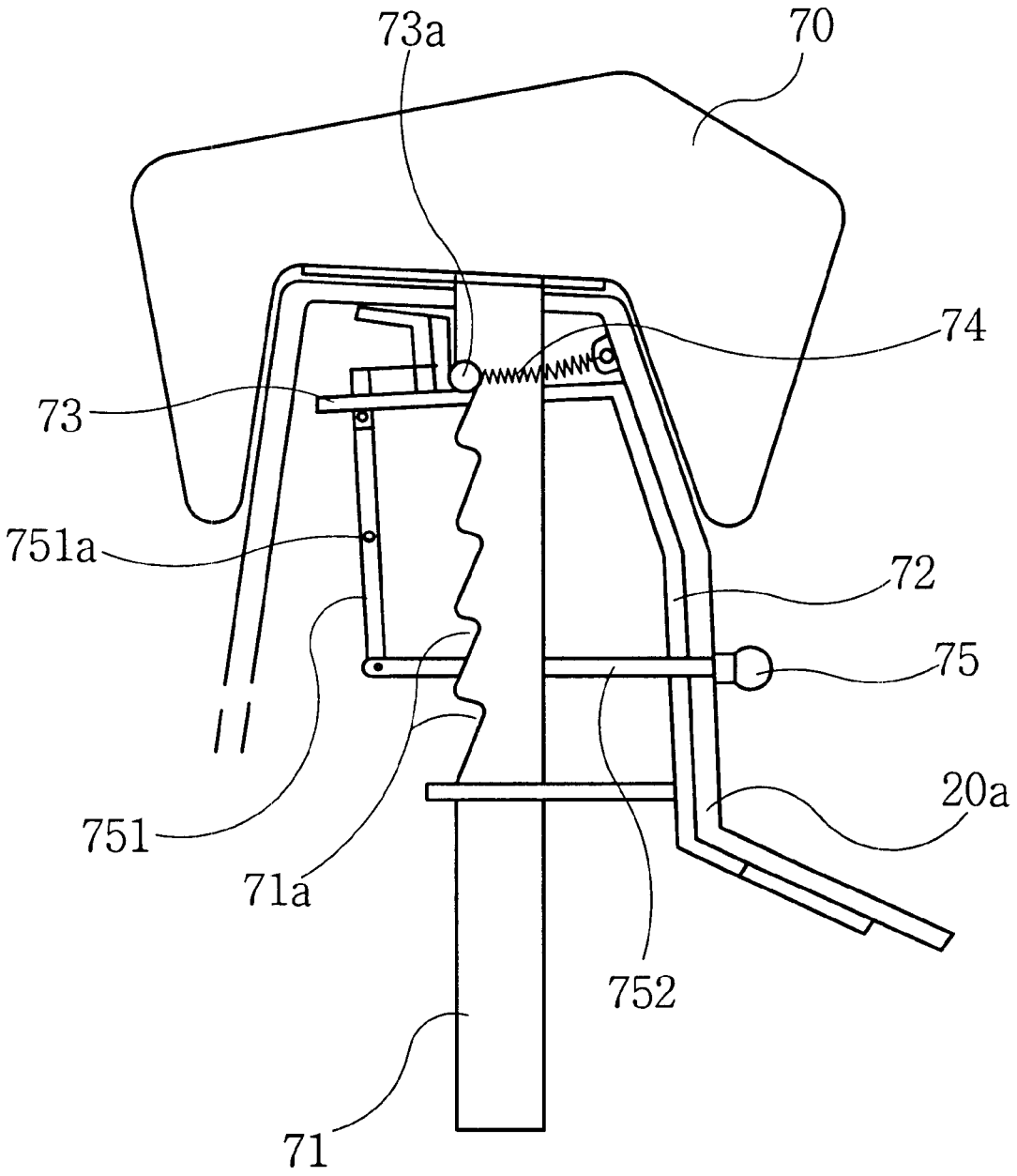
FIG. 13 is a side sectional view showing the actuation of the ankle cushion lifting mechanism of the massage chair according to the present invention.

FIG. 12 is an exploded perspective view showing the constitution of the ankle cushion lifting mechanism of the massage chair according to the present invention. FIG. 13 is a side sectional view showing the actuation of the ankle cushion lifting mechanism of the massage chair according to the present invention.

As shown in FIG. 12, the ankle cushion lifting mechanism of the massage chair capable of massaging a foot by utilizing a whirlpool according to the present invention includes: a pair of lifting bars 71 installed within the front wall of the foot bath tub 30 vertically movably, and having a plurality of engaging slots 71*a;* a bracket 72 attached on the inside of the front wall 20*a* of the supporting structure 20, for supporting the lifting bars 71; an engaging bar 73 contacted to the lifting bars 71, elastically supported by a pair of tension springs 74 and having an elastic member to be inserted into one of the plurality of the engaging slots 71*a* so as to limit the descending of the lifting bars 71; and a knob 75 exposed to the front portion of the foot bath tub 30, and connected through a horizontal link 752 and a vertical link 751 for forcing the horizontal motions of the engaging bars 71.

In the ankle cushion lifting mechanism constituted as described above, the ankle cushion 70 is secured in such a manner that it can be lifted while it cannot be lowered. If the knob 75 is pulled out, then engaging parts 73*a* of the engaging bar 73 are disengaged from the engaging slots 71*a* of the lifting bars 71, thereby setting free the lifting bars 71. Therefore, the ankle cushion 70 is allowed to come down. On the other hand, if the knob 75 is released from the holding, then the engaging parts 73*a* of the engaging bar 73, which have been withdrawn, are restored to the original positions owing to a tension spring 74 to be engaged into the engaging slots 71*a* of the lifting bars 71, thereby stopping the ankle cushion 70 at the current position.

Owing to such an actuation of the ankle cushion lifting mechanism, the ankle cushion 70 is made stationary at the current position after being lifted up to a certain height. That is, the ankle cushion 70 is made stationary upon releasing the knob 75. Thus, if the user wants to raise the position of the ankle cushion 70, then the user can pull the knob 75, raise the ankle cushion 70 and release the knob 75, so that the ankle cushion 70 can be made stationary at the desired height. On the other hand, if the user wants to bring down the ankle cushion 70, then the user can pull the knob 75, press down the ankle cushion 70 and release the knob 75, thereby securing the ankle cushion 70 at the brought-down position.

According to the present invention as described above, not only the back and neck of a human body can be massaged, but also the instep and sole of a foot can be massaged by utilizing a whirlpool of water of the foot bath tub. Thus the fatigue of the foot can also be relieved.

Further, the inclination angle of the seatback can be adjusted, and the seat cushion can be moved back and forth, while the inclination angle of the seat cushion can also be adjusted. Further, the height of the ankle cushion of the foot bath tub can also be adjusted. Accordingly, the massage chair of the present invention can be applied flexibly in accordance with the length of legs and the postures of the user.

Further, a foot pad is installed on the bottom of the foot bath tub, and therefore, the entire surface of the foot can be massaged including the sole of the foot, and therefore, the massaging effect can be greatly improved.

What is claimed is:

1. A massage chair comprising:

a supporting structure;

a seat consisting of a seat cushion mounted and secured upon said supporting structure, and a seatback upstanding on a rear edge of said seat cushion;

a massaging mechanism internally installed within said seatback;

a seat moving and securing mechanism for moving said seat cushion back and forth; and a foot bath tub formed on said supporting structure in front of said seat cushion, having water spouting holes on its bottom, on its side walls and on its rear wall respectively, and having a water spouting shower device above it.

2. The massage chair as claimed in claim 1, wherein said seat moving and securing mechanism comprises:

a lower frame installed upon said supporting structure and consisting of a pair of horizontal rails and a pair of threaded leads rotatably secured above the pair of said rails;

a carrying motor installed on said lower frame, for rotating the pair of said leads forward and reverse; and an upper frame for supporting said seat cushion, for sliding along the pair of said rails, and for moving back and forth over said lower frame by an actuation of moving pieces, said moving pieces moving back and forth along the pair of said threaded leads by being coupled to said leads.

3. The massage chair as claimed in claim 2, further comprising a seatback rotating mechanism, said seatback rotating mechanism comprising:

a seatback driving motor assembly installed on an upper frame, and having a reduction mechanism; and an extension rod consisting of a rotatable rod connected to said reduction mechanism of said motor assembly, and a fixed rod serially coupled to said rotatable rod, with its leading end being secured to a fixed rib of a lower portion of said seatback, for being moved back and forth by said rotatable rod so as to forcibly rotate said seatback, said seatback being hinge-coupled to said seat cushion.

4. The massage chair as claimed in claim 3, further comprising a seatback rotating mechanism, said seatback rotating mechanism comprising:

a lifting frame, with its two rear sides being hinge-coupled to said upper frame vertically pivotally; and a link for connecting said lifting frame to a lower edge of said seatback.

5. The massage chair as claimed in claim 1, further comprising a lifting mechanism for said massaging mechanism, said lifting mechanism for said massaging mechanism comprising:

a supporting frame installed on a rear of said seatback, and having a pair of vertical rails and a pair of vertical leads;

an elevating frame having said massaging mechanism, and secured to said supporting frame so as to move up and down along said vertical rails of said supporting frame by a lifting piece, said lifting piece being meshed with said leads; and a driving motor installed on said supporting frame, for rotating said leads forward and reverse to make said elevating frame ascend or descend.

6. The massage chair as claimed in claim 1, wherein said massaging mechanism comprises:

a massaging motor installed on said elevating frame, for being revolved forward and reverse;

a clutch for connecting or disconnecting a power to and from said massaging motor;

an eccentric shaft connected to said clutch, for being revolved eccentrically circularly;

a biased shaft connected to said clutch, for performing precession movements;

a pair of arms, with their rear ends being hinge-connected to said biased shaft, and their middle portions being joint-coupled to a leading end of said eccentric shaft; and a pair of arm brackets, with their lower portions being hinge-coupled to leading ends of said arms, and their both ends having massaging rollers in a rotatable form.

7. The massage chair as claimed in claim 1, further comprising an ankle cushion mounted on and surrounding a front wall of said foot bath tub, for supporting an ankle of a user.

8. The massage chair as claimed in claim 7, further comprising an ankle cushion lifting mechanism, said ankle cushion lifting mechanism comprising:

a pair of lifting bars installed within a front wall of said foot bath tub vertically movably, and having a plurality of engaging slots in each of them;

an engaging bar contacted to said lifting bars, and having an elastic member to be inserted into one of the plurality of said engaging slots so as to limit a descending of said lifting bars; and a knob connected to said engaging bar, with its leading end being exposed toward a front portion of said foot bath tub, for forcing a horizontal motion of said engaging bar.

9. The massage chair as claimed in claim 1, further comprising a pair of arm rests respectively coupled to said upper frame, at least one of them being pivotal.

10. The massage chair as claimed in claim 1, further comprising heating wires internally installed within said seatback and within said seat cushion.

* * * * *

UNITED STATES PATENT AND TRADEMARK OFFICE

CERTIFICATE OF CORRECTION

PATENT NO. : 6,503,212 B2
DATED : January 7, 2003
INVENTOR(S) : Park

It is certified that error appears in the above-identified patent and that said Letters Patent is hereby corrected as shown below:

Column 6,
Line 33, “sit” should be -- sits --;

Column 8,
Line 49, “seatback rotating mechanism” should be -- seat cushion lifting mechanism --.

Signed and Sealed this

Sixteenth Day of September, 2003

JAMES E. ROGAN
*Director of the United States Patent and Trademark Office*